United States Patent [19]

Carpenter

[11] 4,037,655

[45] July 26, 1977

[54] METHOD FOR SECONDARY RECOVERY OF OIL

[75] Inventor: Neil L. Carpenter, Kerrville, Tex.

[73] Assignee: Electroflood Company, Houston, Tex.

[21] Appl. No.: 624,391

[22] Filed: Oct. 21, 1975

Related U.S. Application Data

[63] Continuation of Ser. No. 462,326, April 19, 1974, abandoned, which is a continuation-in-part of Ser. No. 228,846, Feb. 24, 1972, abandoned.

[51] Int. Cl.[2] ..... E21B 43/24

[52] U.S. Cl. ..... 166/248; 166/245; 166/60; 166/272; 166/303

[58] Field of Search ..... 166/248, 60, 272, 65 R, 166/303, 245; 204/129

[56] References Cited

U.S. PATENT DOCUMENTS

| | | | |
|---|---|---|---|
| 849,524 | 4/1907 | Baker | 166/248 |
| 1,784,214 | 12/1930 | Workman | 166/248 |
| 2,799,641 | 7/1957 | Bell | 166/248 |
| 3,507,330 | 4/1970 | Gill | 166/248 |
| 3,518,036 | 6/1970 | Staats et al. | 204/129 X |
| 3,547,193 | 12/1970 | Gill | 166/248 |
| 3,605,888 | 9/1971 | Crowson et al. | 166/248 |
| 3,620,300 | 11/1971 | Crowson | 166/248 |
| 3,782,465 | 1/1974 | Bell et al. | 166/248 |

OTHER PUBLICATIONS

Composite Catalog of Oil Field Equipment & Services, 25th Rev., 1962–1963, vol. 1, pp. 197, 1521, World Oil, Houston, Texas.

Muskat, "Physical Principles of Oil Production", 1st Edition, 1949, McGraw-Hill Book Co., Inc. N.Y., N.Y.

*Primary Examiner*—Stephen J. Novosad

*Attorney, Agent, or Firm*—Bard, Springs, Jackson & Groves

[57] ABSTRACT

In one exemplar embodiment, method and apparatus include providing an electrode disposed in a plurality of vertically spaced boreholes penetrating the formation. The plurality of electrodes in contact with the salt water and oil of the formation are connected to a source of electrical power for establishing an AC electrical field of current flow between the spaced elctrodes. The electrodes are insulated from the earth structure surrounding the borehole for preventing an electrical current path between the electrodes and the earth structure for isolating the electrical current path from the electrode into the formation. The AC electrical current path through the formation generates volumes of free hydrogen in the formation where it is trapped for increasing the formation pressure. The increased pressure of the formation will drive the oil into producing boreholes spaced from the electrode boreholes.

10 Claims, 18 Drawing Figures

METHOD FOR SECONDARY RECOVERY OF OIL

CROSS-REFERENCE TO RELATED APPLICATION

This is a continuation of co-pending U.S. Pat. application Ser. No. 462,326, filed Apr. 19, 1974, now abandoned, which was a continuation-in-part of co-pending U.S. Pat. Application Ser. No. 228,846, filed Feb. 24, 1972, now abandoned.

BACKGROUND OF THE INVENTION

This invention relates to method and apparatus for establishing an A.C. electrical field in a subsurface oil or mineral bearing formation and establishing in response to the electrical field a zone of electrochemical activity resulting in electrochemical reactions with constituent elements of the earth formation for increasing the internal pressure of the earth formation over an area greatly exceeding the zone of electrochemical activity.

Until fairly recent times, it was relatively easy to find new oil reserves when a field was depleted or became unprofitable. In many fields only 15–25% of the oil in place was actually recovered before reservoir pressure or drive was depleted or other factors made it uneconomical to continue to produce the field. As long as new reserves were readily available, old fields were abandoned. However, with the crisis now confronting the domestic oil industry, coupled with the fact that most of the existing on-shore oil in the United States has already been discovered, it is obvious that such known reserves must be efficiently and economically produced.

It has been estimated that at least 50% of the known oil reserves of the United States cannot be recovered using conventional pumping methods. A substantial amount of this oil is of an abnormally low gravity, and/or high viscosity, often coupled with the fact that there is little or no pressure in the oil-bearing formation. In the absence of formation pressure, even oil of average viscosity and gravity is difficult to produce without adding external energy to the formation to move the oil into a producing borehole. Accordingly, a great deal of attention has recently been given to various methods of secondary recovery. Water flooding has been utilized with mixed results to attempt to increase the natural reservoir pressure hydraulically. Thermal flooding techniques, such as fire flooding, steam injection and hot water flooding have been utilized to alter the viscosity of the oil and hence, enhance its flow characteristics. However, none of these thermal techniques contributes to increasing the formation pressure and have been successful only in a limited number of applications. All of the methods mentioned above require extensive, and quite expensive, surface installations for their utilization.

The prior art contains patents that have introduced electrical currents into a subsurface oil- or mineral-bearing formation for the express purpose of heating the formation in order to lower the viscosity and stimulate the flow of the oil or mineral in the immediate area involved in the heating process. Examples of such patents are: U.S. Pat. No. 849,524 (Baker, 1907); 2,799,641 (Bell, 1957); 2,801,090 (Hoyer, 1957); 3,428,125 (Parker, 1969); 3,507,330 (Gill, 1970); 3,547,193 (Gill, 1970); 3,605,888 (Crowson, 1971); 3,620,300 (Crowson, 1971), and 3,642,066 (Gill, 1972). All of the above patents depend in some form on electrothermic action to enhance the flow characteristics of the oil or an "electro osmosis" action whereby the oil tends to flow from an electrically charged positive region to a negatively charged region. However, none of the above patents suggests the establishment of a zone of electrochemical activity wherein an electrochemical reaction is promoted with constituent elements of the formation, salt water and oil, for increasing the internal pressure of the formation over an area greatly exceeding the zone of electrochemical activity.

Accordingly, one primary feature of the present invention is to provide method and apparatus for establishing a zone of electrochemical activity in a subsurface formation resulting in electrochemical reactions with constituent elements of the formation, such as salt water and oil, for generating volumes of gas in the formation for increasing the formation pressure.

Another feature of the present invention is to provide method and apparatus for establishing a zone of electrochemical activity in a subsurface formation for enhancing the flow characteristics of oil in the formation by lowering the viscosity of the oil.

Yet another feature of the present invention is to provide method and apparatus for establishing a zone of electrochemical activity in a subsurface formation for releasing salt water and oil in situ from the formation matrix within the zone of electrochemical activity and separating the oil and salt water within the earth formation matrix by gravitational action.

Still another feature of the present invention is to provide method and apparatus for establishing an electric field within the subsurface formation wherein a plurality of electrodes is employed, each of the electrodes projecting into the formation through one of a plurality of spaced boreholes and an insulating means is utilized for insulating each of the electrodes from the earth structure surrounding the borehole for preventing an electrical current path between the electrode and the earth structure and isolating the electrical current path from the electrode into the earth formation.

SUMMARY OF THE INVENTION

The present invention remedies the problems of the prior art by providing a method of secondary oil recovery from a subsurface earth formation comprising establishing an A.C. electrical field within the subsurface formation generally defined by a plurality of spaced electrodes extending into the formation and establishing a zone of electrochemical activity in the formation in response to the established electrical field and generally defined by the electrical field and resulting in electrochemical reactions with constituent elements of the earth formation, such as salt water and oil, for increasing the internal pressure of the earth formation over an area exceeding the zone of electrochemical activity by generating volumes of free hydrogen in the formation. The zone of electrochemical activity also enhances the flow characteristics of the oil by lowering the viscosity of the oil. The increased pressures of the formation act to drive oil into a producing borehole spaced from the zone of electrochemical activity. The electrochemical activity also releases the salt water and oil from the earth formation matrix within the zone of electrochemical activity and separates the oil and salt water within the earth formation matrix by gravitational action.

The apparatus for accomplishing the above described method is, in one preferred embodiment, comprised of a plurality of spaced boreholes drilled into the earth formation, a plurality of electrodes, one each of which is disposed in each of the boreholes extending from the surface of the earth into the subsurface earth formation, a source of electrical current connected to each of the electrodes for establishing an electrical field within the subsurface earth formation generally defined by the plurality of spaced electrodes, and a producing borehole drilled into the earth formation spaced from the electrode boreholes for removing oil from the earth formation. In another preferred embodiment, the insulating means may be electrically insulating casing set into each of the boreholes between the surface of the earth and the top of the subsurface earth formation. Other means may be added to an electrode well for cooling the casing of the well from the heat generated by the passage of electrical current in the formation.

BRIEF DESCRIPTION OF THE DRAWINGS

In order that the manner in which the above-recited advantages and features of the invention are attained can be understood in detail, a more particular description of the invention may be had by reference to specific embodiments thereof which are illustrated in the appended drawings, which drawings form a part of this specification. It is to be noted, however, that the appended drawings illustrate only typical embodiments of the invention and therefore are not to be considered limiting of its scope, for the invention may admit to further equally effective embodiments.

In the drawings.

DETAILED DESCRIPTION OF THE PREFERRED EMBODIMENTS

Figure 1:
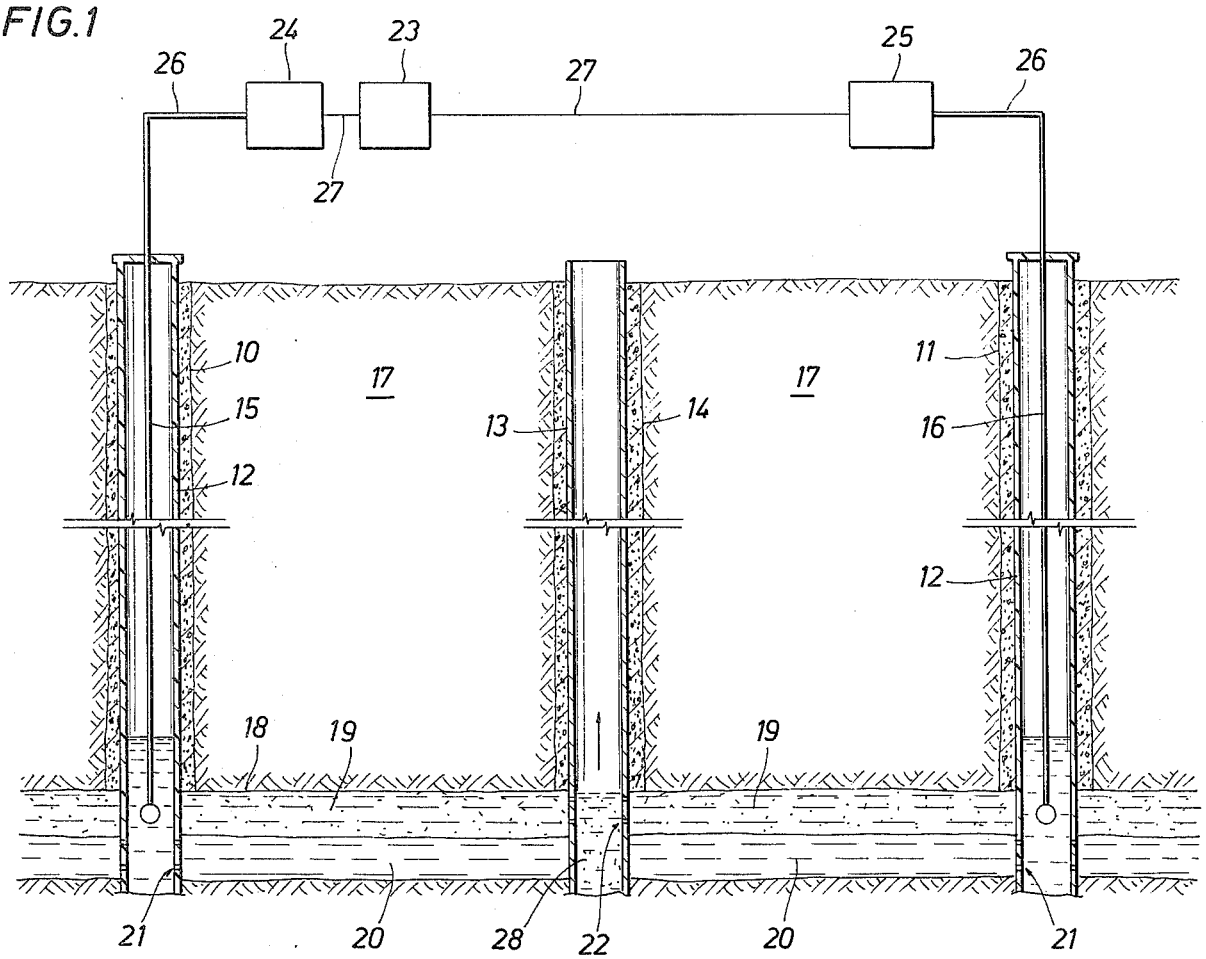
FIG. 1 is a cross-sectional view illustrating a pair of electrode well bores penetrating an oil-bearing formation for passing electric current therethrough in accordance with one embodiment of the present invention.

For a formation or reservoir to be productive, a couple of conditions must exist. First, a pressure differential must exist between the formation and the well bore. Energy for the pressure differential may be supplied naturally in the form of gas, either free or in solution, evolved under a reduction in pressure. The energy may involve a hydrostatic head of water behind the oil, or the water under compression. In cases where the natural energy forces within the formation are not sufficient to overcome the retarding forces within the formation or reservoir, external energy must be added. Secondly, the produced oil must be displaced by another fluid, either gas or water.

Reservoirs are ordinarily classified according to the type of reservoir energy that is available. The four types are solution gas drive reservoirs, gas expansion reservoirs, water driving reservoirs, and gravitational drainage reservoirs. A particular reservoir may, of course, involve more than one of these producing mechanisms.

In those cases where the natural energy of the reservoir is insufficient to overcome the resistive forces such as the forces of viscous resistance and the forces of capillary action, external energy must be applied. To illustrate such cases, this phenomenon is typically encountered in shallow formations containing high viscosity oil that has little or no reservoir energy or formation pressure available, and in those oil-producing formations in which the reservoir energy has been depleted or dissipated. In this discussion, we have been referring to "mechanical" forces acting within the producing formation. In a formation in which the natural energy of the reservoir has been depleted, the mechanical forces in the formation have reached near equilibrium and no pressure differential is available to drive the oil from the formation into the well bore. In all of the cases where reservoir energy was depleted by conventional primary production, or non-existent in the first instance, the chemical balance of the producing formation remains undisturbed and in virtual equilibrium.

Artificial forces introduced into the reservoir such as water or gas through various "pressuring" or "flood" techniques of secondary recovery can effect a mechanical change in the formation by way of pressure. Steam pressure is likewise effective, with some side benefits from heat. Combustion of some of the oil in the formation through "fire-flooding" and heating a well bore serve to reduce the viscosity of the oil in place and enhance flow characteristics but lack a drive to force the oil through the formation and into a producing well bore. However, these are primarily mechanical forces applied and operating only on an exposed face or surface of the formation, and if some chemical or molecular change is accomplished in the fluids in the formation, it is limited to a localized phenomenon. The instant invention will enhance the flow characteristics of the oil in the formation and generate energy in the form of gas produced in the formation for increasing the formation differential pressure and thus the available reservoir energy. These factors are achieved by applying electric current to the formation resulting in an electro-chemical action on the fluids in the formation.

Referring now to FIG. 1, there may be seen a simplified diagrammatic illustration of a portion of a subsurface earth formation 18 containing both oil and salt water. More particularly, the formation 18 may be seen to have been penetrated by three separate boreholes 10, 11 and 14. Two of these boreholes, 10 and 11, are preferably lined with an electrically non-conductive or insulating casing 12, whereas the third or producing borehole 14 may be lined with conventional steel casing 13. Because of the action of the force of gravity, it will be noted that the oil in the formation 18 will usually tend to collect in the upper reaches or strata 19 of the formation 18, whereas the salt water, which is heavier than oil, will tend to collect in the lower portion or strata 20 of the formation 18 beneath the oil. Accordingly, the electrically non-conductive casing 12 in the two boreholes 10 and 11 will preferably be provided with perforations 21 at a level in the lower salt water zone or strata 20 of the formation 18, whereas the steel casing 13 in the third well 14 will preferably have perforations 22 at an upper level in the oil zone or strata 19 of the formation 18. Thus, only the salt water 28 in the formation 18 will tend to enter and at least partially fill the casing 12 of the two boreholes 10 and 11.

Referring again to FIG. 1, it may be seen that a pair of metallic electrodes 15 and 16 have been inserted to a depth in each of the two wells 10 and 11, whereby their lower ends are each deeply immersed in the salt water which is collected in the casing 12. The upper ends of both electrodes 15 and 16 are connected by suitable leads 26 and suitable regulating and control equipment 24 and 25 to an electrical power supply 23 by means of conductors 27. The electrical power supply 23 is of appropriate size and capacity for generating electric current that may be conducted into the contents of casing 12 and into the salt water zone 20 of the formation 18.

Oil is a poor conductor of electricity, while salt water disposed in a formation is a good conductor. Since an electric current will follow the path of least resistance, current which is applied to the electrodes 15 and 16 from the power supply 23 will flow directly across the salt water zone 20 of the formation 18 between the two electrodes 15 and 16, and the salt water therein will tend to be heated in accordance with the amount of salt water which is interposed therebetween and the magnitude of current being applied to the electrodes 15 and 16. The heated salt water will act as a heating element with respect to the oil in the zone or strata 19, whereby the viscosity of the oil may be decreased, thus enhancing the flow characteristics of the oil in the formation.

The above discussion relating to FIG. 1 assumes a heating of a defined salt water strata in an oil-bearing formation which will heat the overlying oil strata, thereby lowering the viscosity of the oil and improving its flow characteristics in the formation. However, if a natural driving energy is not present in the reservoir or formation, lowering the viscosity of the oil will not greatly enhance oil production, since there is no formation pressure or force available to move the oil from the formation to the bore hole. For reasons to be hereinafter further described, transmitting an electric current through the formation fluids, such as salt water or strata 20 of formation 18, will generate volumes of gas within the formation 18 by electro-chemical action for providing internal formation pressure to drive the oil into producing borehole 14 of FIG. 1.

Figure 2:
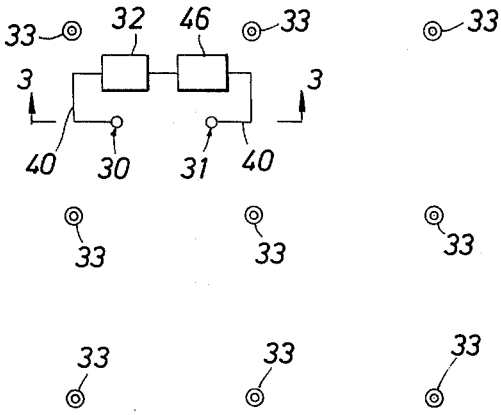
FIG. 2 is a diagrammatic view showing one suggested distribution of electrode wells in accordance with a second embodiment of this invention, with the electrode wells shown in relation to conventional oil-producing wells.
Figure 3:
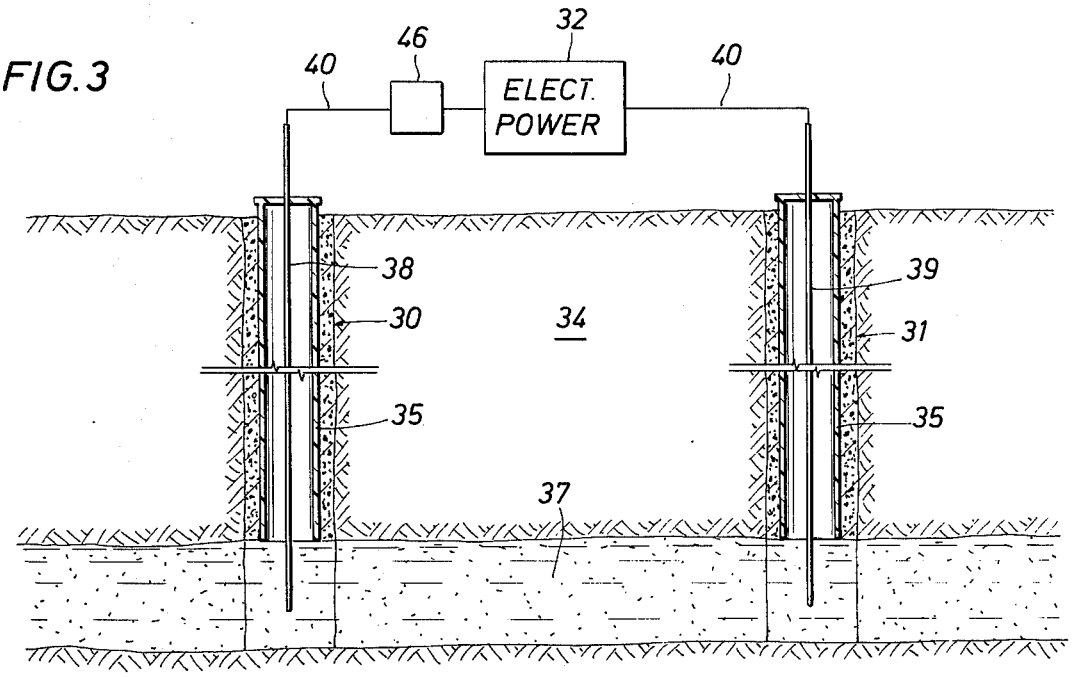
FIG. 3 is a cross-sectional view illustrating a pair of electrode well bores penetrating an oil-bearing formation adapted for passing an electric current therethrough in accordance with the second embodiment of the present invention.
Figure 4:
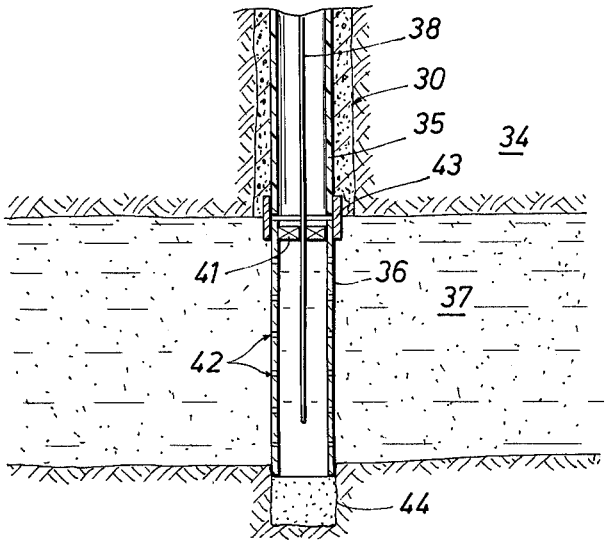
FIG. 4 is a fragmentary detailed view of another embodiment of the apparatus disposed in a borehole shown in FIG. 3 penetrating the oil-bearing formation.

Referring now to FIGS. 2, 3 and 4, another embodiment of the apparatus for secondary recovery of oil from a subsurface oil-bearing earth formation is disclosed. A pair of boreholes 30 and 31 are shown penetrating the overlying earth 34 and an oil-producing earth formation 37. Boreholes 30 and 31 are preferably lined with an electrically non-conductive casing 35 and conventionally cemented down to the point at which the earth 34 adjoins the oil-bearing formation 37. In the embodiment of FIG. 3, the boreholes are completed "barefoot," that is, no casing is set in the oil-bearing formation 37 and the borehole is left unlined. In FIG. 4, another embodiment is shown, where a steel casing section 36 is set in the borehole in formation 37 and has perforations 42 completed therein. Collar 43 couples the insulating casing 35 and steel casing 36. The steel casing 36 can be anchored by a conventional cement plug 44.

A pair of metal electrodes 38 and 39 are inserted one into each of boreholes 30 and 31, respectively, and extend through the insulating casing 35 into the oil-bearing formation 37 as shown in FIG. 3 or into the steel or electrically conducting casing section 36, as shown in FIG. 4. The electrodes may be centralized within insulating casing 35 by means of packers (not shown in FIG. 3) and within the electrically conducting casing section 36 (see FIG. 4) by means of a packer 41 that is set just below the joint of the insulating casing 35 and the electrically conducting casing 36 for purposes to be hereinafter further explained. Electrical power is provided by generator 32 and is connected to electrodes 38 and 39 by means of conductors 40. Suitable regulating and timing apparatus 46 may be utilized to regulate the electric power and to time the length of the application of power to the formation, as will hereinafter be further explained.

Formation 37 may contain many conductive elements, but the salt water ordinarily associated with oil-bearing formations is highly conductive. Such salt water, called "connate" salt water, is often distributed throughout an oil-bearing formation such as formation 37 because of capillary action, in spite of gravitational forces tending to remove the water to the bottom of the formation. The sand grains of the oil-bearing formation matrix retain a film of salt water which, in turn, attracts a film of oil. Although oil is a poor conductor of electricity, the connate salt water distributed throughout the formation is capable of transmitting an electric current.

As may be seen in FIG. 3, the boreholes 30 and 31 allow oil and salt water from formation 37 to enter the boreholes and make contact with electrodes 38 and 39. Upon application of the electrical current from generator 32 to electrodes 38 and 39, an electric current is passed between electrodes 38 and 39 through the oil-bearing formation 37 in substantial isolation from the earth 34 above and below formation 37 by means of the connate salt water contained within the formation acting as an electrolyte. In the embodiment of FIG. 4, because of the effective electrical contact between the ends of electrodes 38 and 39 within steel casing section 36 and the salt water within the casing and in contact with the electrode, the effective size of the electrode is increased to the diameter of the electrically conducting casing 36.

The heating of the salt water within boreholes 30 and 31 or in casing section 36 by the action of the electrical current will raise the temperature of the salt water appreciably, often to 200° F. or greater. Often the pressures in the borehole use several hundred psi and drive the heated fluids from the formation up into the casing 35. These temperatures can have a damaging effect on the non-conductive casing 35, which can conveniently be fiberglass casing, causing it to warp or buckle and collapse if the temperatures rise appreciably over 200° F. In the embodiment shown in FIG. 4, the packer 41 seals the annulus between casing 36 and electrode 38 and prevents hot salt water from expanding up into casing 35 and damaging the lower end of the casing.

In some cases it may be necessary to replenish the salt water in electrically conducting casing 36 and in the formation 37 surrounding casing 36. In that event, the solid electrodes 38 and 39 shown in FIG. 3 may be replaced with a hollow tubular member acting as an electrode, such as jointed strings of tubing. Thus salt water at the surface of the borehole may be introduced into the conductive casing 36 and formation 37 through such a tubing string electrode to enhance the electrical contact between the electrode and the formation 37.

The electrical current source 32 may conveniently be a single-phase AC source of electric power, or it may be a pulsed DC power source. The use of a DC power source may have certain disadvantages, such as the high cost of obtaining a DC source of sufficient voltage and current capacity, erosion of the electrodes due to electrolysis, and the possibility of generating highly poisonous chlorine gas from the electrolysis of salt water. However, under suitable conditions, it is believed that DC power will be as effective as AC power.

Figure 16:
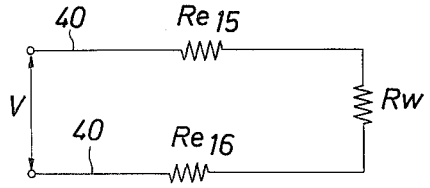
FIG. 16 schematically illustrates the path for flow of current in accordance with the embodiment of the invention illustrated in FIG. 2.

When the source of electrical power is connected between conductors 40 and electrodes 38 and 39, current will flow through a series path comprised of conductor 40, the resistance of the electrode 38 designated $R_{e38}$, the resistance of the water in the oil-bearing formation 37, designated $R_w$, the resistance of the electrode 39, designated $R_{e39}$, and conductor 40, as shown in FIG. 16. The current flowing in this circuit can be expressed mathematically as:

$$I = \frac{V}{R_{e38} + R_{e39} + R_w}$$

and the power dissipated in the water will, of course, be equal to $I^2R_w$. It will, therefore, be apparent that it is very desirable that the resistance of the water providing a conductive path between electrode 38 and electrode 39 have a high resistance as compared to the total series resistance of the electrodes, $R_{e38} + R_{e39}$. In fact, to achieve this relationship in some instances it may be desirable to utilize electrodes formed of aluminum or similar material characterized by a lower resistivity than steel. The current flowing through the circuit can be controlled by varying the supply voltage potential by means of regulating apparatus 46 or by varying the resistivity of the water. The power dissipated in the water, acting as a resistor, is manifested in the form of thermal energy or heat which is in turn distributed to the formation. As the salt water temperature rises, the resistance of the salt water declines, thus allowing a greater current to flow through the formation.

The result of the flow of current between electrodes 38 and 39 through the connate water in the oil-bearing formation 37 will be to produce an electric current flow through the oil-bearing earth formation 37, since the overlying or underlying earth structures 34 are fully insulated from electrodes 38 and 39 by casing 35. Accordingly, the electric current flow will be substantially confined to the oil-bearing formation 37 due to the insulation of the earth formation 34 from electrodes 38 and 39. The action of the electrical current passing through earth formation 37 will heat the formation due to the resistance of the salt water and because of electrochemical reactions with constituent elements of earth formation 37, namely, the salt water and the oil, and will enhance the flow characteristics of the oil within the earth formation 37 and will provide increased internal pressure within the formation 37 to drive the oil into a producing borehole, such as boreholes 33 in FIG. 2, remote from electrode boreholes 30 and 31. The current will be conducted, due to the resistance characteristics of the salt water, through a lateral area within the earth formation 37 greater than the area defined by the direct path between the spaced boreholes 30 and 31.

The electrochemical action of the electrical current will produce at least the following known phenomena:

1. Reduction in the viscosity of the oil in the formation, thus enhancing the flow characteristics of the oil;
2. Generation of large volumes of gas in the formation due to electrochemical action with the oil and salt water in the formation;
3. Release of the oil and water from the earth formation matrix, thus allowing the oil to separate due to gravitational action to an upper level of the formation and the salt water to gravitate to a lower level of the formation.
4. Production of heat in the formation matrix traversed by the current as a direct result of chemical reactions taking place with the constituent elements of the formation, including at least the salt water and the oil.

To reduce the viscosity of the oil, the electrical current apparently causes an electrochemical action that changes the molecular structure of the oil. Of course, heat generated by the electrical current will also alter the viscosity of the oil. It is believed that the electrochemical action of the electric current will increase the gravity of the oil over a limited range of values.

Tests in the field, utilizing the two-well, single-phase AC power installation, as shown in FIGS. 2 and 3, have resulted in significantly elevated formation pressures, up to a 300 psi increase, over a large area, approximately 1,000 acres or more, as remote as 4,000–6,000 feet from the electrode well installation. In addition, many remote, open producing wells also produced a clear burning, volatile gas that is believed contained methane and free hydrogen. A substantial pressure was maintained in some of the producing wells even after the electrode wells had been shut down for as long as 30 days. This result was achieved after some 120,000 kw of electrical power were injected into the producing formation. Such production of gas within the producing formation can provide energy within the formation to repressure the reservoir if the natural energy of the reservoir is insufficient to overcome the resistive forces such as the forces of viscous resistance and the force of capillary action.

The source of the gases generated in the formation and the reasons for its production are not fully understood at this time. But several explanations based on laboratory experiments may be offered. They are:

a. production of free hydrogen and oxygen by electrolysis of the salt water contained in the formation;
b. chemical action of hydroxides, resulting from electrolysis of the salt water, acting on the oil in the formation;
c. direct molecular conversion of large oil molecules to hydrocarbon gas molecules such as methane;
d. release of gas molecules in solution in the salt water present in the formation;
e. release of solution gases by heat, such as methane and carbon dioxide, present in the oil;
f. formation of hydrocarbon gases by action of the hydrogen gases "hydrogenating" the oil;
g. formation of carbon dioxide by the action of nascent oxygen reacting with the carbon molecules in the oil; and
h. formation of carbon dioxide by action of nascent oxygen combining with carbonates commonly present in the salt water in some oil-bearing formations.

It is known that heating of oil in the formation will release solution gases from the oil and salt water. Thus, release of solution gas will occur in the heated areas surrounding the electrode boreholes, and release gases such as methane gas and carbon dioxide dissolved in the oil. But the large pressure increases encountered in the field under actual test over widespread distances and the results of lab tests cannot be accounted for solely on the basis of release of solution gas by electrothermal action.

Laboratory tests have shown that an oil and salt water mixture will produce, under the action of an electrical current, large volumes of free hydrogen and carbon dioxide, and lesser volumes of free oxygen, methane, ethane, propane and butanes plus. The free hydrogen is obviously the result of the electrolysis of the salt water, which also produces either free oxygen or a hydroxyl radical present in the water. With nascent oxygen generated by electrolysis, the presence of the carbon dioxide could be the result of (g) or (h) above. Some of the hydrocarbon gases may be the result of "hydrogenation" of the oil by free or nascent hydrogen as described in (f) above.

In direct molecular conversion of a hydrocarbon molecule chain to form molecules of hydrocarbons that remain in liquid form and others that take the form of a gaseous hydrocarbon, the electrical current is acting directly on the hydrocarbon molecule to cause the conversion or breakdown for reasons not presently fully appreciated. But this phenomena could account for a substantial part of the hydrocarbon gases produced in the formation.

Methane is slightly soluble in water, due to a slight attraction between methane molecules and water molecules. However, it is known that carbonates and bicarbonates present in the water will increase the solubility of methane in the water. In the formation matrix, the connate water molecules collect around methane molecules to form a cage-like film held together by hydrogen bonds. Since the water molecules have an unusually large dipole moment (1.8 Debye units), the molecules rotate in response to an impressed electric field. The exposed hydrogen protons of the water molecules turn toward the negative potential of the electrical field. This rotation of the water molecules in response to an electrical field can break the hydrogen bonds between the water molecules, thus releasing the methane molecule. This chemical action of releasing the methane molecules trapped in the connate salt water would also generate heat, which indicates that a heating effect due to chemical reactions also takes place in the formation traversed by the current.

As hereinbefore mentioned, laboratory experiments have shown that oil will be released from sand grains under the influence of an AC current, and it is believed that under certain conditions such action will take place in a reservoir formation. The reasons for this release of the oil and connate water from the sand grains in the presence of an AC current are not fully understood but may be the result of the rotation of the water molecules in the connate water under influence of the electric field, as hereinabove described, that break hydrogen bonds with the oil film that coats the connate water droplet that surrounds the sand grains of the formation matrix. Further the release of methane molecules from the connate salt water, as above described, would also dislodge oil molecules from the residual oil film that coats the connate water droplet surface, thus dislodging both the methane molecules to form gas for pressurizing the formation and for freeing oil molecules that tend to move, because of gravitational forces, to the upper strata of the formation. The water freed of the formation matrix would tend to gravitate to the lower portion of the formation. Such a release of oil from the formation matrix, and gravitating to the upper strata of the formation, would make enhanced recovery of the oil a real possibility, particularly in formations where water is the driving force creating the reservoir energy.

With the production of gas within the oil-producing formation 37 (see FIG. 3), and the energy that the production of such gas imparts to the formation, it can be seen that the process can be utilized either in a single installation of a pair of boreholes as shown in FIGS. 2 and 3, or in a plurality of installations distributed within a given field or reservoir, to restore energy to the reservoir for creating a driving force for moving the oil from the oil-bearing formation into a producing well bore. As seen in FIG. 2, a typical electrode well installation having wells 30 and 31 will cause a resulting increase in formation pressure within the producing formation, thereby enhancing the recovery of oil through producing wells 33. After substantial volumes of gas have been generated in the producing formation and an optimum formation pressure is achieved, the electrode boreholes 30 and 31 may have power shut off for predetermined periods and only operate for selected periods of time to maintain the desired formation pressure. Regulating and timing apparatus 46 (see FIGS. 2 and 3) can be utilized to regulate the current flow and automatically turn the current source off and on at desired intervals. Such regulation of the current flow can also be utilized to control pressures and temperatures in the electrode boreholes.

In summary, a subsurface mineral bearing formation can be treated by establishing an electrical field within the formation generally defined by a plurality of spaced electrodes extending into the formation and by establishing in response to said electrical field a zone of electrochemical activity in the formation, the zone of electrochemical activity being generally defined by the electrical field and resulting in electrochemical reactions with constituent elements of the formation for increasing the internal pressure of the formation over an area exceeding the zone of electrochemical activity. The primary constituent elements of the earth formation include salt water and oil. The electrochemical reactions with the salt water and oil increase the internal pressure of the earth formation by generating volumes of gas within the formation and further act to enhance the flow characteristics of the oil by lowering the viscosity of the oil. In a secondary recovery operation, the oil can be withdrawn from the formation in response to the increased formation pressure through a producing borehole penetrating the formation and spaced from the zone of electrochemical activity. Of course, oil could also be withdrawn within the zone of electrochemical activity.

Figure 5:
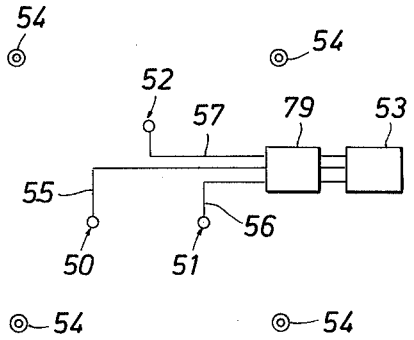
FIG. 5 is a diagrammatic view showing a second suggested distribution of electrode wells in accordance with a third embodiment of this invention with the electrode wells shown in relation to conventional oil-producing wells.
Figure 8:
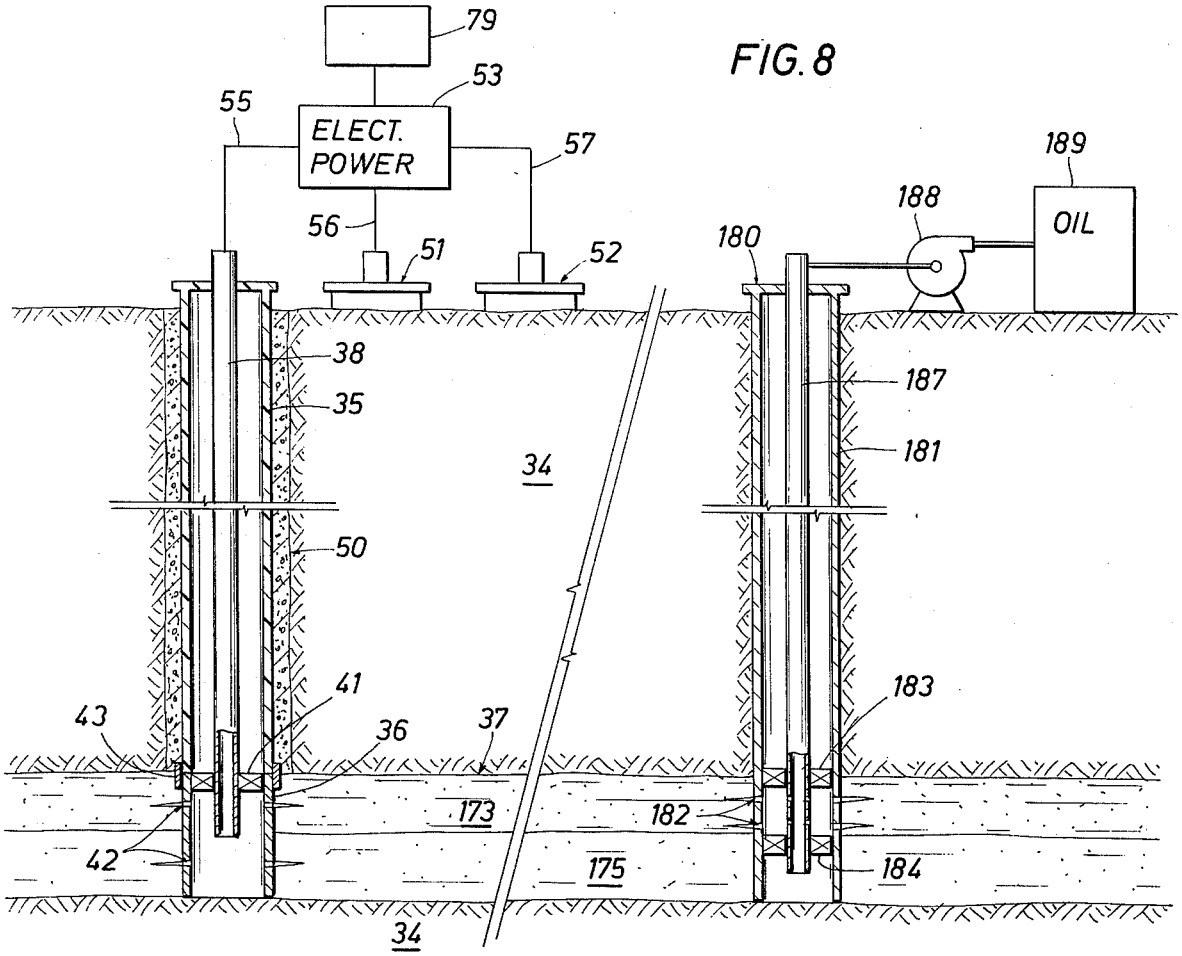
FIG. 8 is a diagrammatic view, partly in cross-section, illustrating a plurality of electrode well bores penetrating an oil-bearing formation in accordance with the embodiment illustrated in FIG. 5 and illustrating the relationship between the electrode well bores and a producing well where the oil and salt water have been released from the formation matrix.

Referring now to FIGS. 5 and 8, a diagrammatic view of the distribution of three electrode wells disposed in a triangular pattern in a field of oil-producing wells is shown. Three electrode wells 50, 51 and 52 are shown spaced in a triangular pattern, with electrical power supplied by source 53 and distributed to the electrodes in wells 50, 51 and 52 by conductors 55, 56 and 57, respectively. A regulator and timer apparatus 79 is connected to the power source for regulating the current through the boreholes. The electrode wells 50, 51 and 52 may be completed in the same manner as the electrode wells 30 and 31 shown in FIGS. 3 and 4, and the reference numbers in FIG. 8 relating to the electrode borehole 50 are identical to the reference numbers of borehole 30 shown in FIGS. 3 and 4. In practice, use of three-phase AC power, with each of the three phases connected to one of the electrodes of boreholes 50, 51 and 52, has been found to be more efficient than use of single-phase AC power in a two-well arrangement shown in FIG. 2, for reasons to be further explained. The three-well, three-phase AC electrode well installation shown in FIGS. 5 and 8 will cause the same electrochemical actions to take place in the formation 37 as those described with respect to FIGS. 2–4. In actual tests, substantial formation pressure increases were noted up to 8,000–10,000 feet away after operation of the three-well installation after only 40,000 kw were injected into the producing formation. This is about one-third of the total kw necessary to effect lesser pressure increases in utilizing the single-phase AC electrode installation as depicted in FIGS. 2 and 3.

Referring further to FIG. 8, a producing well bore 180 is shown having a conventional casing 181 perforated in the upper strata 173 of formation 37 for reasons to be hereinafter further discussed. A tubing string 187, through which oil is to be produced from formation 37, is disposed in the borehole and centralized by packers 183 and 184. Pump 188 pumps oil through tubing 187 into a storage tank 189.

As hereinbefore discussed with relation to FIGS. 2 and 3, one of the phenomena occurring as a result of the electrochemical action of the electrical current is the separation of the oil and water from the formation matrix and the gravitation of the oil to an upper strata of the formation and the water to a lower strata of the formation. Accordingly, utilizing the three-well, three-phase AC power installation of electrode boreholes 50, 51 and 52 (FIG. 8) the passage of electrical current through formation 37 would release oil and salt water from the sand matrix of formation 37, allowing the oil to gravitate to an upper strata or level 173 while the water would gravitate to a lower strata or level 175. If producing well 180, remote from the electrode well installation, is completed in strata or level 173, then oil recovery would be enhanced, since no salt water from strata 175 would be produced.

Figure 6:
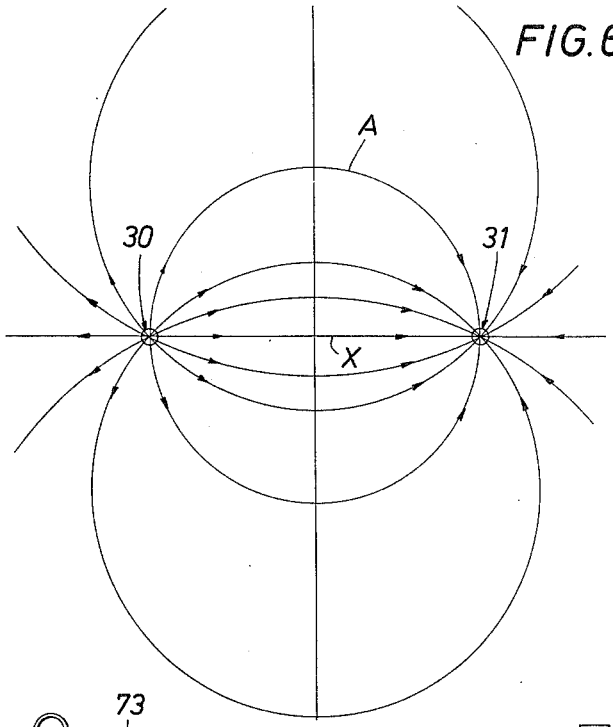
FIG. 6 is a diagrammatic view illustrating lines of current in a subsurface formation between a pair of electrode wells.

Referring now to FIGS. 2, 5, 6 and 7, power distribution in the earth formation can be explained. In FIG. 6 assumed lines of current flow are illustrated for the two electrode arrangement shown in FIG. 2. For simplicity all curves are assumed to be circles. Hence the lengths of the current paths can be calculated from measurements of the radii and angular lengths of arcs. Assuming the resistance to current flow is directly proportional to the length of the current path, then the power dissipated can be calculated as:

$$P = I^2R = \frac{V^2}{R}$$

where:

$P$ is the power dissipated
$I$ is the current
$R$ is the resistance
$V$ is the voltage impressed across the resistance
Substituting L (length of the current path) for R:

$$P = \frac{V^2}{L}$$

the power at each circular arc relative to that along the direct line X between electrodes can be calculated.

Calculations show that greater than 50% of the power due to the current flow will be dissipated in a circle whose diameter is equal to the distance between the centers of the two electrodes, as can be seen in the circle shown at A in FIG. 6, thus causing a zone within circle A of great electrochemical activity reacting with the salt water, oil and other constituent elements of the formation. Of course, a great amount of power will be dissipated in the formation outside of circle A, and, correspondingly, chemical reactions are also taking place in this greater zone.

Figure 7:
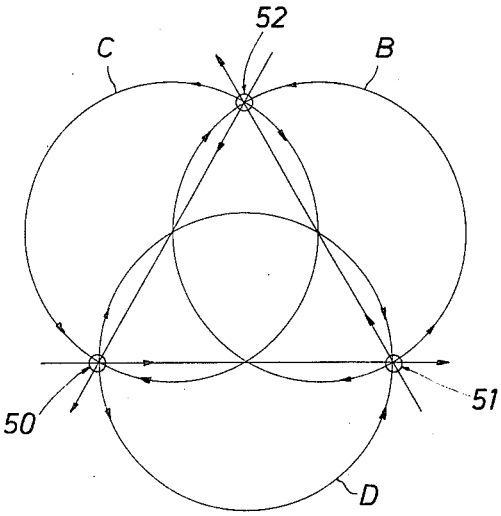
FIG. 7 is a diagrammatic view illustrating lines of current in a subsurface formation between three electrodes utilizing three-phase AC current.

Referring to FIG. 7, a triangular spacing of electrodes is shown as in FIG. 5, with the application of three-phase AC current to the three electrode wells. Here three overlapping circles B, C and D are shown as the greater than 50% power dissipation zones between each of the three wells. As can be seen by reference to FIG. 6, the three-well, three-phase arrangement treats over twice the area that can be treated by a single installation of two wells. In addition, the overlapping zones of the power distribution circles may enhance the electrochemical activity in those areas, thereby enhancing the results obtained. In field testing the spacing between the two-well arrangement shown in FIG. 2 was 100 feet while the three-well pattern shown in FIG. 5 utilized a 200-foot spacing. From comparisons of FIGS. 6 and 7, it can be seen that the area of formation treated by the electrical field and the established electrochemical zone of activity will be much larger than the area created by a two-well arrangement, and taking into account the increased spacing in the three-well test, the power distribution may have been increased by a factor of three or four or more. This can reasonably explain why in actual field testing, as hereinabove described, the three-well, three-phase AC installation obtained increased formation pressures over a larger reservoir area with about a third of the power required in the two-well single-phase AC test.

Figure 9:
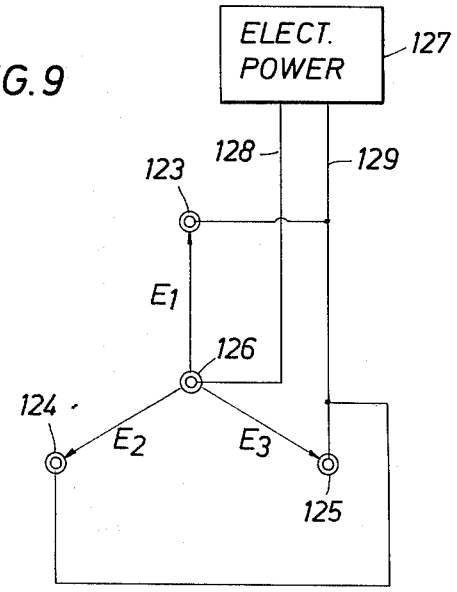
FIG. 9 is a diagrammatic view showing a third suggested distribution of electrode wells in accordance with a third embodiment of the invention.
Figure 10:
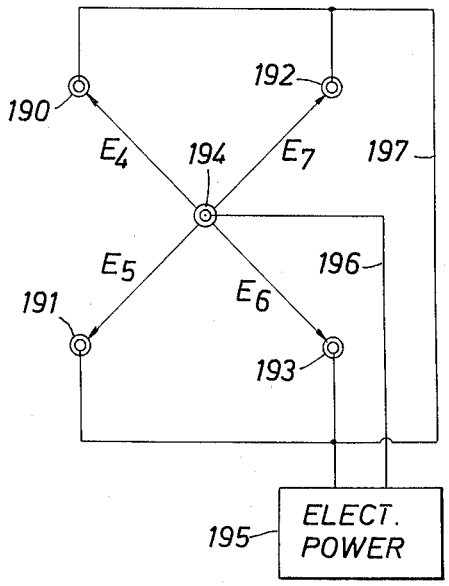
FIG. 10 is a diagrammatic view showing a fourth suggested distribution of electrode wells in accordance with a fourth embodiment of the invention.

Accordingly, greater effects may result from multiple electrode well patterns that treat as large a zone of the formation as possible and practical. Increased spacing of the electrodes may enhance results; however, more power will be required to treat the formation volume as the separation of the electrodes increases. FIG. 9 illustrates a four-well pattern in a triangular configuration with one electrode well in the center. Electrode wells 123, 124 and 125 define the triangular pattern and well 126 is positioned equidistant from each of the three wells. AC or pulsed DC power is supplied by a source 127 and is applied to wells 123, 124 and 125 by conductors 129. A return path is provided by electrode well 126 and conductor 128. In this configuration, three well-pairs can be established with a voltage drop between well-pairs as shown by $E_1$, $E_2$ and $E_3$. FIG. 10 illustrates a five-well pattern in a square or diamond configuration with one electrode well in the center. The electrode wells 190, 191, 192 and 193 define the square or diamond pattern with well 194 acting as the center well. A source of electrical power 195 is connected to electrode wells 190–193 by conductors 197 and to the center electrode well 194 by means of conductor 196. In this configuration, four well-pairs are established with a voltage drop between well pairs as shown by $E_4$, $E_5$, $E_6$ and $E_7$. Obviously, other patterns having a plurality of electrode pairs can be utilized to treat a subsurface earth formation. The number, pattern and spacing of the electrode wells will determine the pattern, area, size and intensity of the electrical field established and of the electrochemical field established.

Figure 11:
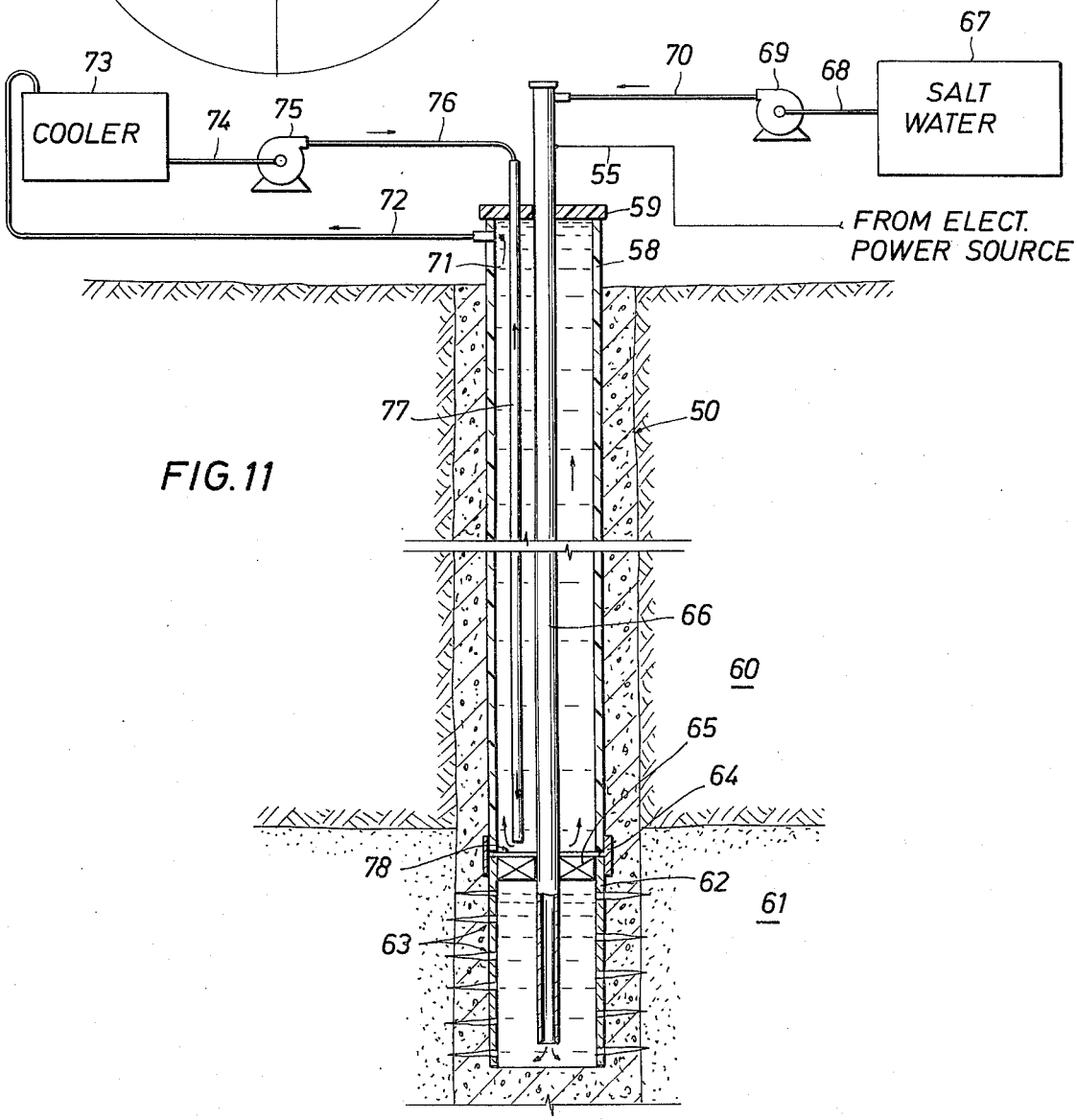
FIG. 11 is a cross-sectional view illustrating one embodiment of the apparatus for equipping an electrode well bore penetrating an oil-bearing formation.

Referring now to FIG. 11, another embodiment of an electrode well apparatus is diagrammatically shown. The apparatus may be utilized in a two-well installation, as shown in FIGS. 2 and 3, or a three-well installation, as shown in FIGS. 5 and 6. A borehole 50 is shown penetrating earth formation 60 and oil-bearing formation 61. The borehole is lined through the earth 60 with a non-conductive or electrically insulating casing 58, such as fiberglass, and is lined in the oil-producing formation 61 by means of steel casing section 62, joined to the insulating casing 58 by means of a collar 64. The electrically conducting casing section 62 is conventionally perforated into the oil-bearing formation 61 by means of perforations 63. A first tubing string 66 is suspended within the insulating casing 58 and extends into the steel casing section 62, terminating just above the lower end of steel casing 62. Tubing string 66 is centralized within the borehole 50 by means of a packer 65 which is set just below the joint 78 of the insulated casing 58 and steel casing section 62, for purposes which will be hereinafter further described. A second tubing string 77 is also suspended within casing 58, spaced from tubing string 66, and terminates just above packer 65.

Casing 58 is sealed by means of a flanged cap or head 59 through which the tubing strings 66 and 77 project. Tubing string 66 acts as the electrode for the electrode well and is energized by means of electrical power from a source such as source 53 through conductor 55, as shown in FIG. 5, or from source 32 as shown in FIG. 3.

As previously discussed, the heating action of the electrical current passing through the salt water in the oil-bearing formation causes an increase of temperature within the well bore. The temperatures in the immediate vicinity of the electrode, and particularly within steel casing section 62 and in the salt water surrounding tubing string 66, acting as the electrode, can become quite high, on the order of 200° F. or higher. If the salt water within steel casing section 62 backed up into the insulating casing 58, the high temperatures might result in damage to the insulating casing, such as fiberglass, and damage to the borehole. Thus, packer 65 is set just below the joint 78 between the insulating casing 58 and the steel casing 62 to insure that salt water will not rise above packer 65 and contact the lower portion of insulating casing 58.

Under the pressures encountered in the well bore and the temperatures produced by the process, the salt water within the well bore and in the immediate surrounding area of the oil-producing formation 61 may be reduced to steam, which is not an electrical conductor. Accordingly, to enhance the electrical contact between formation 61 and electrode 66, it may be necessary to add salt water from time to time to the borehole 50 from a salt water source 67, via piping 68 and 70 and pump 69, if necessary, through the tubing string 66 to the interior of casing section 62. Thus, salt water can be introduced into the interior of steel casing 62 and into the formation 61 to maintain electrical contact with the connate salt water in formation 61. In addition, the absence of the water conductor encourages electrical arcing which can damage both the steel casing 62 and the electrode 66.

Even as hereinabove described with packer 65 set to prevent heated salt water from rising into and damaging the lower portion of insulating casing 58, the joint 78 may still become extremely hot because of heat conduction through casing 62 and collar 64; and to further alleviate the risk of damage to casing 58, a system for cooling the joint 78 may be utilized which includes filling the annular space within casing 58 with a cooling fluid 71, such as diesel oil or other thin petroleums, or even water, and circulating the fluid through tubing 77 by means of a pump 75, and piping sections 72, 74 and 76 and a cooler 73. The circulating flow of fluid through tubing string 77 over the heated joint 78 and casing 58 will cool the lower portion of fiberglass casing 58 and maintain the temperature of the casing at an acceptable level.

Figure 12:
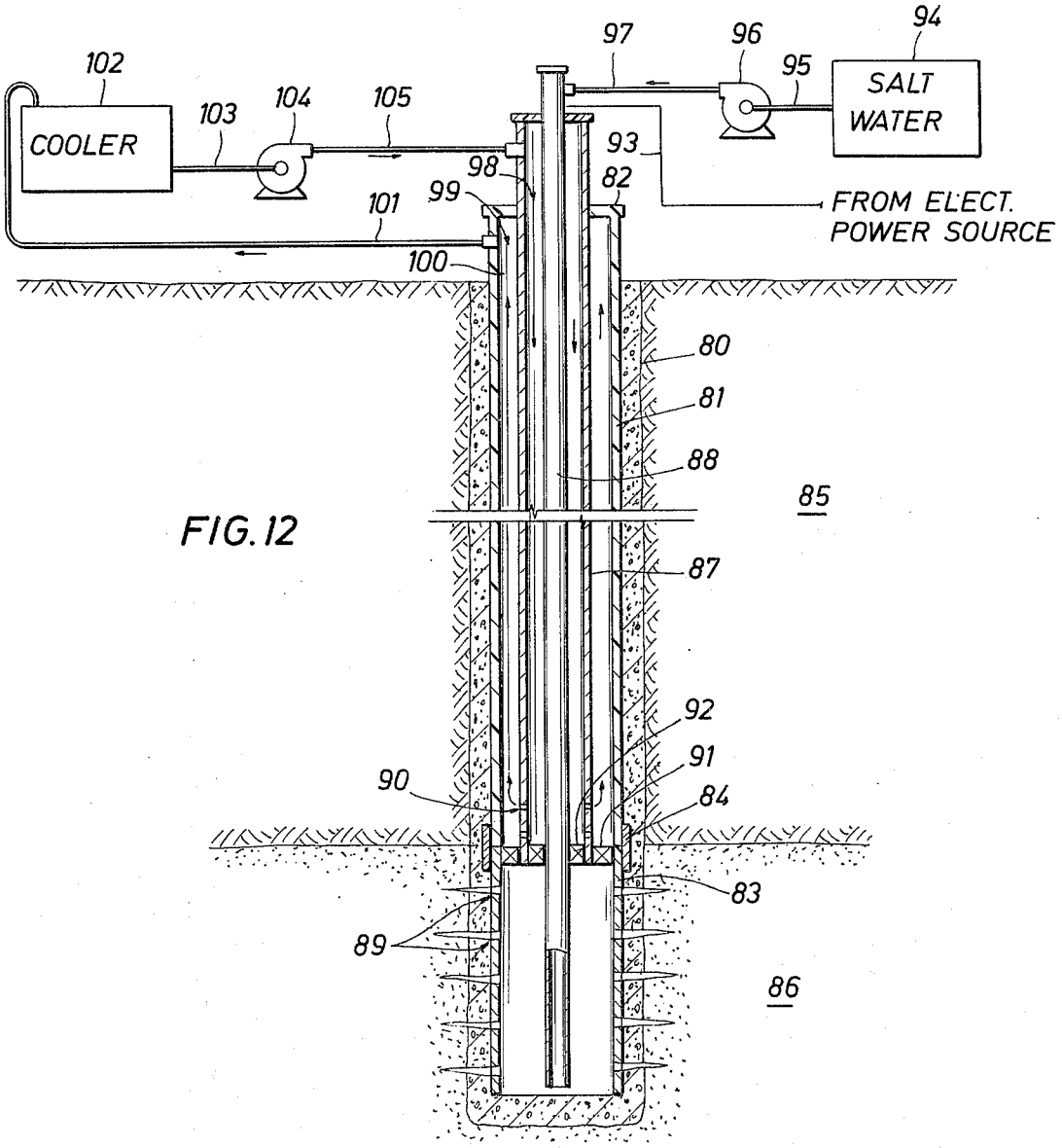
FIG. 12 is a cross-sectional view illustrating another embodiment of the apparatus for equipping an electrode well bore penetrating an oil-bearing formation.

Referring now to FIG. 12, another embodiment of the apparatus that may be utilized as an electrode well for use in two-well installations such as those shown in FIGS. 2 and 3, or in three-well installations as shown in FIGS. 5 and 8, is diagrammatically illustrated. A borehole 80 is shown penetrating an earth formation 85 into an oil-producing formation 86. The borehole 80 is lined with a non-conductive or insulating casing 81, preferably fiberglass casing, through the earth formation 85 and is lined in the oil-producing formation 86 by means of a steel casing section 83. Steel casing section 83 is conventionally completed utilizing perforations 89 into the oil-producing formation 86. A string of tubing 87 of smaller diameter than casing 81 is concentrically suspended within casing 81 to a point approximating the joinder of the earth formation 85 and the oil-producing formation 86. Tubing 87 may either be conventional steel tubing or may be an insulated or non-conductive tubing. A string of suitable tubing 88 is concentrically suspended within tubing 87 and projects into the interior of steel casing section 83 to act as an electrode and to provide means of adding salt water to the formation, if necessary, as previously described with regard to the apparatus shown in FIG. 11. Casing 81 is closed with a cap 82, and tubing 87 is appropriately sealed to tubing 88. Packers 91 and 92 are disposed between casing sections 83, the end of tubing 87, and tubing 88 for centralizing and sealing the casing section 83 from the chambers created by insulated casing 81 and the tubing 87, as will be hereinafter further described.

Tubing 88 becomes an electrode when connected by means of conductor 93 to an appropriate source of electrical power, such as source 53, as shown in FIG. 5, or the source of electrical power 32, as shown in FIGS. 2 and 3. A salt water tank 94 is connected to a pump 96 by means of piping 95, the pump in turn being connected to tubing string 88 by means of piping 87 for providing a means for pumping salt water into the interior of steel casing section 83 and thence into the formation 86 for the reasons hereinabove described with regard to the apparatus shown in FIG. 11.

Tubing 87 has perforations 90 completed just above the area where packers 91 and 92 have been set for providing communication with the interior of tubing 87 and the interior of casing 81. Cooling fluid 100 is introduced into the interior annular space of tubing 87, and can then be circulated through tubing 87, through perforations 90, and into the annular space of casing 81 to cause the fluid to flow over the joint between insulating casing 81 and steel casing section 83 to cool the lower portion of casing 81 for the purposes hereinabove described with regard to the apparatus shown in FIG. 11. Fluid from the interior of casing 81 will be circulated through piping 101 to a cooler 102, and then piped via piping 103 to pump 104, where the fluid is transported through piping 105 to the interior annular space 98 of tubing 87. The cool fluid travels down the annular space 98 within tubing 87, out through perforations 90, over the lower portion of the insulated casing 81, and returns through the annular space 99 of casing 81 to return to the cooling means 102 via piping 101. In this way, cooling of the lower section of the insulating casing 81 may be effected for the purposes hereinabove described.

Figure 13:
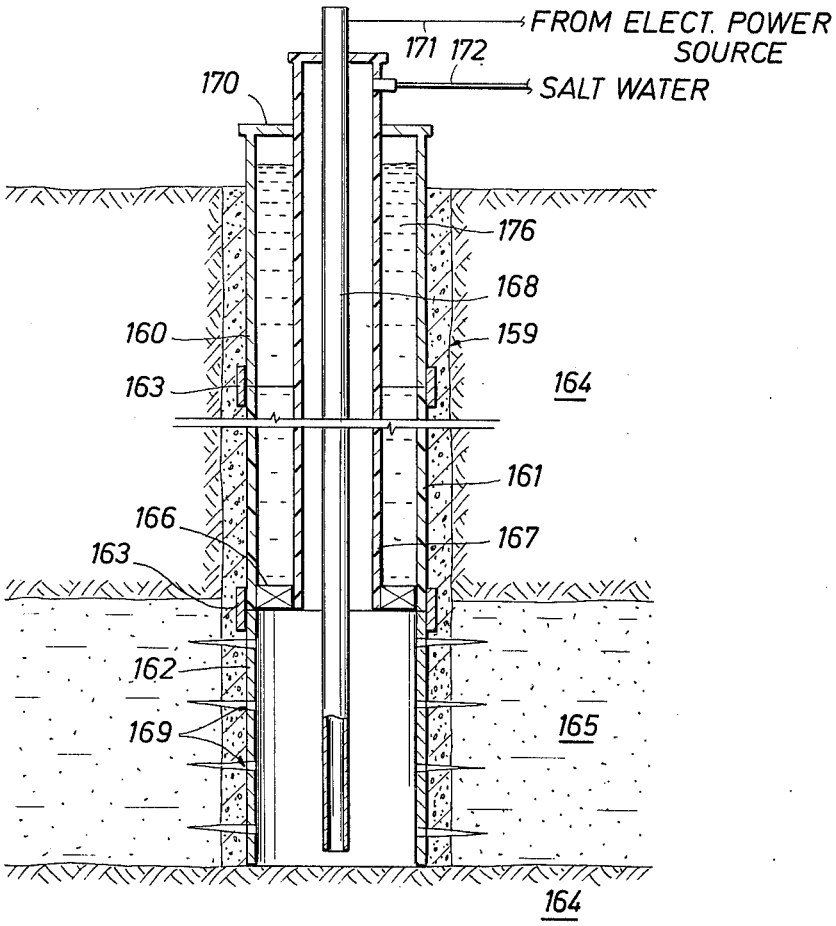
FIG. 13 is a cross-sectional view illustrating yet another embodiment of the apparatus for equipping an electrode well bore penetrating an oil-bearing formation.

Referring to FIG. 13, yet another apparatus embodiment for equipping a well bore is shown. The apparatus of FIG. 13 could be utilized in a two-well installation shown in FIGS. 2 and 3, or in a three-well installation shown in FIGS. 5 and 8. A borehole 159 is shown penetrating the earth 164 into an earth formation or oil-bearing formation 165. The borehole 159 is lined with conventional steel casing 160 from the surface to a lower point in the earth 164, and then lined with an electrically non-conducting or insulating casing section 161. The borehole in formation 165 is lined with an electrically conducting casing 162. Collars 163 couple casing sections 160, 161 and 162 together. A fiberglass or other electrically insulating tubing 167 is suspended in borehole 159 and centralized and supported by packer 166. Packer 166 also seals the annular space between tubing 167 and casing section 161 for purposes to be hereinafter further explained. Casing 162 has a plurality of perforations 169 displaced therein into the formation 165.

An electrode 168 of suitable material is disposed concentrically within tubing string 167 down into formation 165. An insulated head 170 seals casing 160 around tubing 167, and a suitable head seals tubing 167 around electrode 168. Electrical power from a suitable source is applied to electrode 168 via conductor 171. Piping conduit 172 is connected with the interior of tubing 167 for introducing salt water into the borehole, if necessary, as hereinabove described in connection with the previous embodiments.

In this embodiment, the bore hole is fully insulated with electrically insulating casing. The purpose of the fully insulated casing of previous embodiments is to insulate the electrode from the earth structure for preventing a direct current path between the electrode and the earth structure overlying the oil-bearing formation. In addition, the insulation of the borehole is to prevent a return current path from the electrode disposed in the earth formation back through the borehole to said overlying earth structure. In the embodiment of FIG. 13, a direct current path from the earth structure 164 is prevented by insulating tubing 167 and can be enhanced by filling the annulus surrounding tubing 167 with an insulating fluid such as oil 176. If insulating casing section 161 is of sufficient length, a return current path from the electrode 168 in formation 165 will be effectively broken, thereby effectively insulating electrode 168 from a return current path through borehole 159 into earth structure 164. This isolates the electrical current in formation 165 as previously described.

During operation of the electrode well, formation fluids will tend to back up into tubing 167, exerting substantial pressures on the interior of the tubing, and the addition of oil 176 in the casing annulus can also help equalize this pressure on the insulating tubing. Control of the current flow through electrode 168 and formation 165 for controlling pressure and temperature can be achieved as hereinbefore described by appropriate regulation and/or timing equipment.

Figure 14:
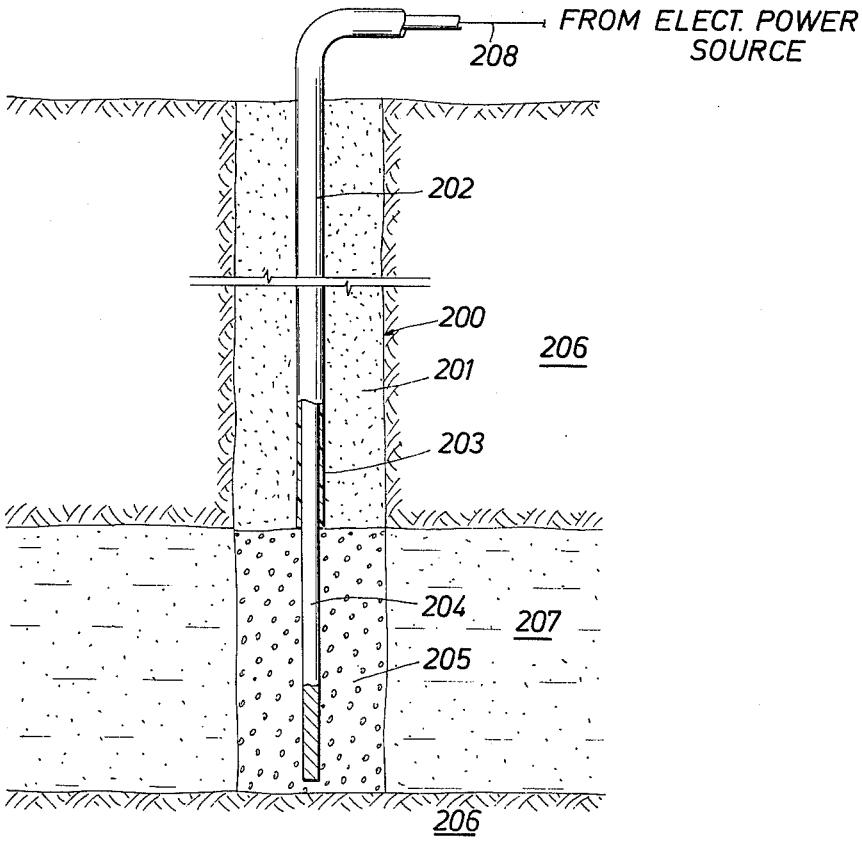
FIG. 14 is a cross-sectional view illustrating still another embodiment of the apparatus for equipping an electrode well bore penetrating an oil-bearing formation.

In FIG. 14 a simple embodiment of apparatus for equipping an electrode well is shown. Borehole 200 is shown penetrating earth strata 206 and oil-bearing earth formation 207. An insulated cable 202 having an electrical insulating jacket or cover 203 and a conductor 204 is disposed in the borehole. Insulating jacket 203 is stripped from the end of the conductor 204 to expose the conductor throughout the earth formation for acting as an electrode. Gravel or other suitable porous material is packed around exposed conductor 204 in the borehole portion extending into the formation 207 to permit the electrode to have communication with formation fluids. The borehole above formation 207 can then be filled with insulating cement 201 to give structural support to cable 202 and to support the borehole without having to set casing. The upper surface end of the cable 202 is connected to a suitable source of electrical power by means of conductor 208. Formation fluids, such as salt water and oil, will flow through the porous gravel 205 and make contact with electrode 204 for establishing the electrical field in the formation 207.

Figure 15:
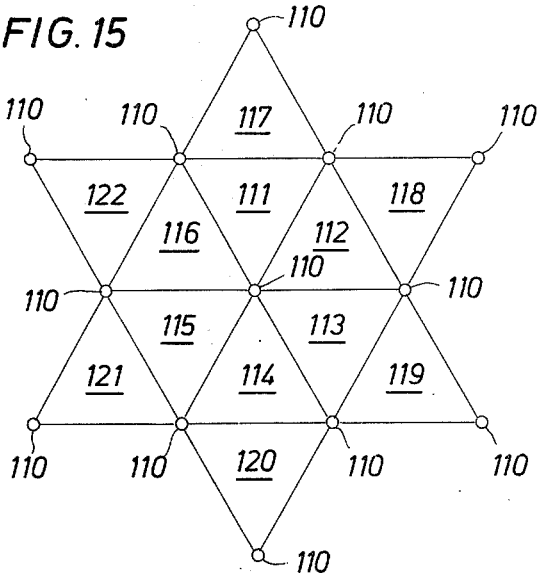
FIG. 15 schematically illustrates one manner in which the principles of the present invention can be applied to produce a series of current-producing patterns for passing electric current through an increasing area of an earth formation.

Referring now to FIGS. 5, 8 and 15, a three-electrode well installation, as shown in FIG. 5, could be effectively patterned as shown in FIG. 15 to progressively cover an increasingly larger area and thereby both heat an increased area of the oil-bearing formation and stimulate gas production in the formation over a much wider area. In FIG. 15, three electrode wells 110 could be drilled and completed in a triangular pattern shown as pattern 111. This installation could be utilized for a predetermined period of time, and then by drilling another electrode well 110, a second triangular pattern 112 could be accomplished and operated for a second predetermined period of time. It is possible to exhaust some of the formation fluids in the area defined by the electrode well bores. However, tests demonstrate that relocation of the electrode pattern provides new formation fluids and also moves new fluids to old areas. By drilling additional electrode wells 110, a series of triangular patterns 113–122 could be accomplished, thus distributing the electrical current over a broad reservoir area. The gas production in the oil-bearing formation would be enhanced, and the thermal action of the electrical current would be distributed over a much wider area in the reservoir oil-bearing formation. Of course, any electrode wells 110 not being utilized as electrode wells in a particular installation pattern may be rigged as producing wells. In actual field tests the spacing of the three electrode wells was 200 feet, but it is believed that much larger distances may be utilized to enlarge an installation pattern and enhance the heat generation and electrochemical generation of gas in situ to pressure the formation. The use of the patterning in 113–122 produces twelve injection patterns for thirteen wells and when completed can be used for six patterns, each four times as large as any original pattern.

As hereinbefore described, laboratory tests have revealed that AC current will cause oil droplets to be released from the sand grains of a simulated formation matrix and that separation of the oil and water is caused by gravitational forces that will force the oil to rise in the matrix while water is displaced to a lower level in the matrix. It is believed that under certain geological conditions this same result can be achieved in an actual reservoir formation. Accordingly, the pattern development disclosed in FIG. 15 could be especially useful to release residual oil remaining within the reservoir pore space and allowing it to move by gravitational force to the upper reaches of the oil-bearing formation for enhancing production from that strata. This is particularly true of the suggested patterns shown in FIG. 15 where broad areas of the formation could be treated simultaneously and successive patterns swept across a predetermined area to treat the formation, generate gas in situ and release the residual oil in the formation pore space to gravitate to the upper strata of the formation.

Figure 17:
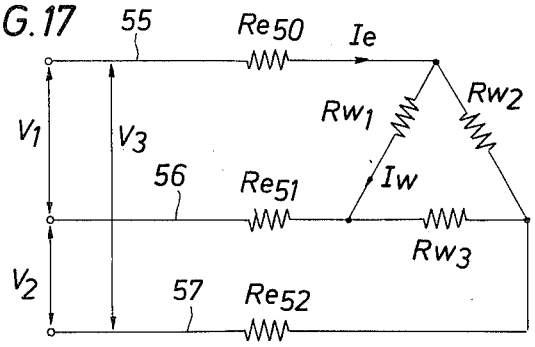
FIG. 17 schematically illustrates the path for flow of current in accordance with the embodiment of the invention illustrated in FIG. 5.

In discussing the three-well, three-phase AC installations, as shown particularly in FIGS. 5 and 8, a simplified circuit schematic of the system can be represented as shown in FIG. 17. With a three-phase AC source 53 (see FIG. 5) connected between electrodes 50 and 51 by conductors 55 and 56, current $I_e$ will flow through conductor 55, tubing electrode 50, represented by resistor $R_{e50}$, through one leg of an assumed "delta" load comprising the conductive substances of the formation, primarily salt water, represented by resistor $R_{w1}$, and then through conductor 56. Assuming a balanced three-phase power source and a balanced "load" (the earth formation) then:

$$V_1 = I_e R_{e50} + I_e R_{e51} + I_w R_{w1}$$

but, since $$I_e = \sqrt{3} I_w$$

$$V_1 = \sqrt{3} I_w R_{e50} + \sqrt{3} I_w R_{e51} + I_w R_{w1}$$

$$V_1 = I_w (\sqrt{3}\, R_{e50} + \sqrt{3}\, R_{e51} + R_{w1})$$

$$I = \frac{V_1}{\sqrt{3}\ (R_{e50} + R_{e51}) + R_{w1}}$$

However, in actual practice the "delta" load representing the oil-bearing formation may not be balanced due to geological variations, and $I_w$ in the various legs of the "delta" system load then would not be balanced and the current, $I_w$, through $R_{w1}$, $R_{w2}$ and $R_{w3}$ would be unequal. While this is true, loads can be balanced in the generator by creating more resistance in the surface cables, or by changing the shape of the pattern to fit resistance requirements.

Figure 18:
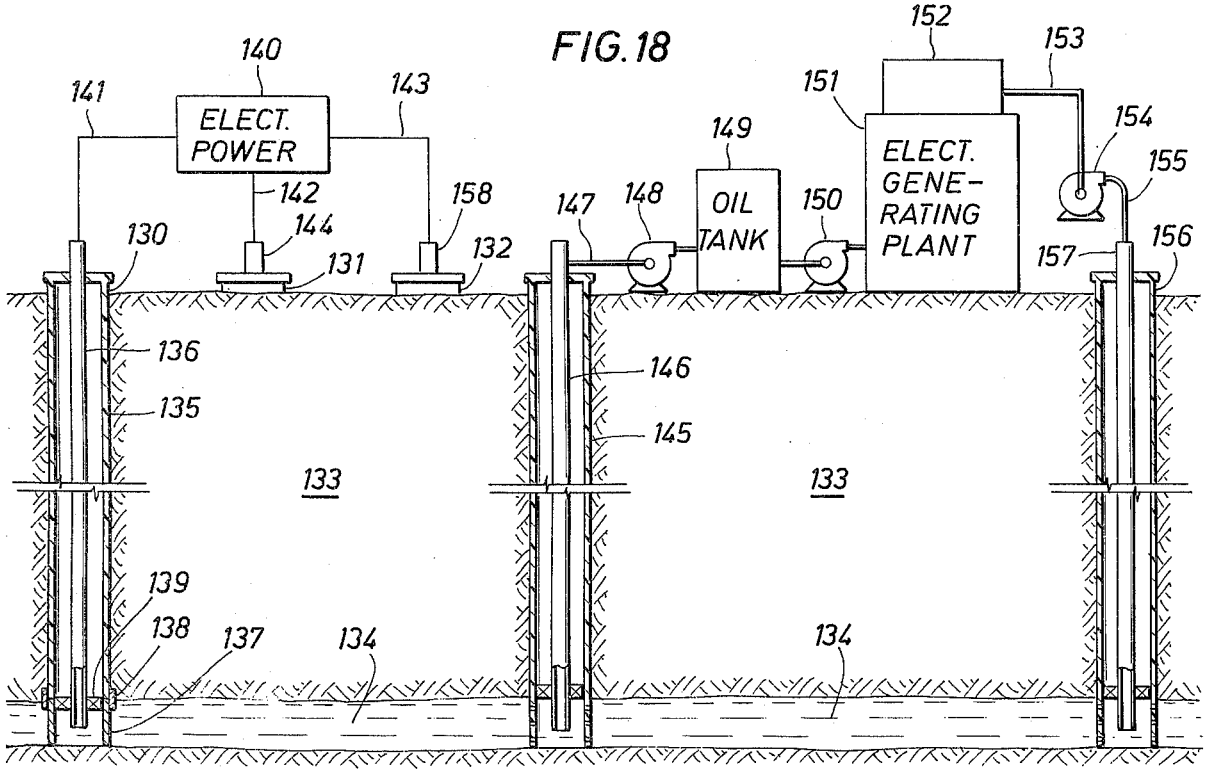
FIG. 18 is a diagrammatic view, partly in cross-section, illustrating a plurality of electrode well bores penetrating an oil-bearing formation, a producing well bore penetrating the oil-bearing formation, and an industrial plant utilizing an oil-fueled energy source with the exhaust gases from the plant being injected into the oil-bearing formation through yet another well penetrating said formation.

Referring now to FIG. 18, yet another embodiment of the apparatus is illustrated. In FIG. 18, an electrode borehole 130 is drilled through earth formation 133 and oil-bearing formation 134 and is shown having an electrically insulating casing 135 and a steel casing section 137 set in the oil-bearing formation 134, the two casing being joined by a collar 138. A tubing string 136 is inserted within well bore 130 and extends into the steel casing section 137. Tubing string 136 is centralized by means of a packer 139 that seals the space within the interior of steel casing section 137 and the interior of insulating casing 135, as hereinbefore described for previous embodiments shown in FIGS. 3, 11 and 12. Of course, the borehole 130 may be constructed alternatively as disclosed in previous embodiments. Two additional boreholes 131 and 132 (not shown in detail) are completed to form a triangular three-electrode well installation, as shown in FIG. 5, for instance. Of course, other multiple well patterns could be utilized. Three-phase AC power would be provided by a generator 140 and applied to electrodes 136, 144 and 158 of boreholes 130, 131 and 132, respectively, by conductors 141, 142 and 143, respectively. Three-phase AC power would be applied to the oil-bearing formation 134 to produce heat and gas in situ, as hereinabove described, to promote oil recovery. A plurality of producing boreholes 145, only one of which is diagrammatically shown penetrating earth formation 133 and the oil-bearing formation 134, would be conventionally completed to produce oil from formation 134. The oil may be produced through a tubing string 146 by various conventional means and supplied via piping 147 to a pump 148 for transfer to an oil storage tank 149. This would be conventional production and storage to this point, assisted by use of the invention to enhance oil recovery. But in a large reservoir, which would contain substantial oil reserves sufficient to support an industrial plant having a need for large volumes of fuel oil as an energy source, the exhaust or "flue" gases from such a plant could be utilized in further enhancing the production capabilities of the reservoir. Assuming the industrial plant to be an electrical generating plant utilizing oil-fired turbines, the plant could be constructed immediately adjacent the reservoir area for receiving the produced oil and for minimizing the distance that the flue gases must be transported prior to use in the reservoir. This embodiment is described in relation to an electrical generating plant, but other industrial plants having a high oil fuel energy need and creating substantial quantities of useful exhaust gases could, of course, be substituted.

Referring again to FIG. 18, the produced oil would be transferred from the oil storage tanks 149 to the electric generating plant 151 by means of pumps 150 for supplying the crude oil to appropriate treating means, if necessary (not shown), to prepare the crude oil for firing the turbine generators. The oil-fired turbines would generate electrical power for distribution by the generating plant in the power company's power distribution system. The output flue gases of the oil-fired turbines would be collected at 152 and routed through piping 153, pump 154 and piping 155 to a pipe or tubing 157 disposed in injection borehole 156, as shown penetrating the earth formation 133 and the oil-producing formation 134. In actual operation, the injection borehole 156 would be located in or adjacent the pattern of the three electrode wells 130, 131 and 132, although not so shown in the diagrammatic illustration of FIG. 18. The hot pressurized flue gas introduced into the oil-beariing formation 134 through injection well 156 will lower the viscosity of the oil and enhance its flow characteristics. The flue gas from an oil-fired turbine or engine will contain carbon monoxide and carbon dioxide as well as other gases. The carbon dioxide and carbon monoxide gases, whether heated or not, will tend to combine with the oil in the producing formation, and in so doing combine chemically with the oil to improve its flow characteristics. In addition, the flue gas will ordinarily be hot (in the range of 800°–1,000° F.) and will act to dissolve tars and lower the viscosity of the oil. In addition, pumping the heated flue gas back into the formation under pressure adds to the formation pressure, thereby enhancing the formation driving energy.

The flue gas will have a considerable BTU content since not all of the hydrocarbons have been burned, and the long term injection of the gas into the formation will create a reservoir of gas having considerable BTU value that could create a source of gas for future recovery and use as a fuel.

The use of the flue gas injection process would be ideally suited for use in an area where there is a large reservoir of very viscous oil or sands having tar oils of extremely low gravity and high viscosity that can be produced by the use of the invention herein described and recovered in quantities sufficient to operate an industrial plant that, in turn, would generate sufficient quantities of exhaust or flue gases that could be returned to the oil formation for the purposes hereinabove mentioned. As an example, a 1-megawatt electrical generating plant could utilize 40,000 barrels of oil a day produced from the oil reservoir and generate 200,000,000 cubic feet of gas a day for reinjection into the oil-bearing formation. This arrangement could have particular economic appear to many industries dependent upon oil or natrual gas as a fuel, since natural gas is in short supply and oil may economically be recovered by use of the electrical process.

In addition, there are environmental benefits accruing from the utilization of the installation and process shown in FIG. 18, since the flue gases would be returned into the ground for use in enhancing recovery of oil and not released into the atmosphere as a pollutant.

Although the present invention has heretofore been described with respect to its utility in effecting the recovery of oil, it will be apparent that the concept of the present invention is also applicable to various other uses such as the removal of impurities from waste water and other industrial fluids. In one such embodiment, the liquid to be purified is collected in a vat or other container which is charged with a brine or other suitable electrolytic solution. A suitable alternating current may then be applied to the terminals of two electrodes which are immersed in a spaced apart relationship in the contents of the container. Accordingly, the current passing through the electrolyte and between the two electrodes will produce separation of solids from the liquid, and these solids will then settle to the bottom of the container as a sludge. This same process can be used as a pre-distillation step in the purification of water for ordinary drinking purposes, inasmuch as impurities such as iron, gypsum and magnesium oxides may be easily separated out in this manner before the distillation step is performed. Combustion gases and smokes can also be removed from air in this manner by passing the polluted air through a chamber containing a pair of electrodes adapted to be charged in this manner.

Numerous variations and modifications may obviously be made in the structure and processes herein described without departing from the present invention. Accordingly, it should be clearly understood that the forms of the invention herein described and shown in the figures of the accompanying drawings are illustrative only and are not intended to limit the scope of the invention

What is claimed is:

1. A method of increasing the internal pressure in a fluid-bearing earth formation, comprising the steps of establishing at least two spaced apart boreholes extending into a subsurface earth formation containing both oil and other aqueous liquids, disposing a separate electrical conductor in each of said boreholes and into electrical contact with said aqueous liquids in said formation, insulating both of said conductors from substantially all earth materials adjacent said boreholes and lying above said subsurface earth formation to establish an electrical path composed of said insulated conductors and said formation materials extending therebetween, establishing an AC flow of electric current in said electrical path composed of said insulated conductors and said formation materials lying therebetween, electrochemically generating free hydrogen gas in said subsurface earth formation between said boreholes as a function of current intensity in said formation, and trapping said free hydrogen gas in said formation to increase the pressure in said formation on said oil therein.

2. The method described in claim 1, further including the steps of establishing another different borehole spaced from said boreholes and also extending into said subsurface earth formation, and withdrawing oil from said formation through said another different borehole in response to said increased pressure in said formation.

3. The method described in claim 2, wherein said another borehole is further spaced from an axis defined by said boreholes containing said electrical conductors.

4. The method described in claim 3, including the step of electrochemically generating free carbon dioxide gas in said formation between said two spaced apart boreholes as a function of current density in said formation.

5. The method described in claim 4, wherein said current flow between said electrodes is a flow of single-phase AC current.

6. The method described in claim 5, further including the step of circulating a cooling liquid within each of said boreholes containing said electrical conductors.

7. The method described in claim 5, further including the step of injecting a quantity of an electrically conductive aqueous liquid into each of said spaced apart boreholes for establishing an electrical coupling between said electrical conductors therein and said aqueous liquids in said subsurface earth formation.

8. The method described in claim 4, further including the steps of establishing a third borehole extending into said formation and spaced generally triangularly from said at least two spaced apart boreholes containing said conductors, disposing a third electrical conductor in said third borehole and into electrical contact with said aqueous liquids in said formation, insulating said third conductor from substantially all earth materials adjacent said third borehole and lying above said formation, and interconnecting a three-phase AC current to said conductors with each conductor receiving a different phase thereof.

9. The method described in claim 8, further including the step of circulating a cooling liquid within each of said boreholes containing said electrical conductors.

10. The method described in claim 8, further including the step of injecting a quantity of an electrially conductive aqueous liquid into each of said boreholes containing conductors for establishing an electrical coupling between said conductors and said aqueous liquids in said subsurface earth formation.

* * * * *

UNITED STATES PATENT OFFICE

CERTIFICATE OF CORRECTION

Patent No. 4,037,655 Dated July 26, 1977

Inventor(s) Neil L. Carpenter

It is certified that error appears in the above-identified patent and that said Letters Patent are hereby corrected as shown below:

In the Abstract, line 7, change "elctrodes" to --electrodes--;

Col. 2, line 46, "A.C." should be "AC";

Col. 4, line 35, insert after "well" --bore--;

Col. 9, line 5, after "It is" insert --further--;

Col. 16, line 14, change "displaced" to --disposed--;

Col. 18, line 42, change "hereinbefore" to --hereinabove--;

Col. 19, line 28, change "three electrode" to --three-electrode--;

Col. 19, line 31, change "beariing" to --bearing--;

UNITED STATES PATENT OFFICE

CERTIFICATE OF CORRECTION

Patent No. 4,037,655 Dated July 26, 1977

Inventor(s) Neil L. Carpenter Page 2 of 2

It is certified that error appears in the above-identified patent and that said Letters Patent are hereby corrected as shown below:

Col. 19, line 65, change "appear" to --appeal--;

Col. 20, line 67, insert before "boreholes" --two--;

Col. 22, line 20, change "electrially" to --electrically--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*